United States Patent [19]

Grevich

[11] 4,373,435

[45] Feb. 15, 1983

[54] CRUSHER AND SEPARATOR FOR CANS AND BOTTLES

[76] Inventor: John J. Grevich, Rte. 1, Box 34, Star Prairie, Wis. 54026

[21] Appl. No.: 222,666

[22] Filed: Jan. 5, 1981

[51] Int. Cl.[3] ..... B30B 9/32

[52] U.S. Cl. ..... 100/49; 100/91; 100/233; 100/295; 100/902; 209/219; 209/636; 209/930; 241/99; 241/264

[58] Field of Search ..... 100/902, 233, 91, 49, 100/295; 241/99, 79.1, 264; 209/219, 636, 930

[56] References Cited

U.S. PATENT DOCUMENTS

| | | | |
|---|---|---|---|
| 2,619,150 | 11/1952 | Smith | 100/49 |
| 2,800,159 | 7/1957 | Walsh | 100/902 |
| 2,900,076 | 8/1959 | Israelson | 209/219 |
| 2,920,554 | 1/1960 | Bunke | 100/902 |
| 3,232,220 | 2/1966 | Sileski | 209/930 |
| 3,687,062 | 8/1972 | Frank | 100/91 |
| 4,084,496 | 4/1978 | Ehernberger | 100/902 |
| 4,216,713 | 8/1980 | Jung | 100/91 |
| 4,225,047 | 9/1980 | Grubman | 209/636 |

FOREIGN PATENT DOCUMENTS

| | | | |
|---|---|---|---|
| 1244682 | 7/1967 | Fed. Rep. of Germany | 100/902 |

*Primary Examiner*—Billy J. Wilhite
*Attorney, Agent, or Firm*—H. Dale Palmatier

[57] ABSTRACT

A can and bottle crusher and separator with stationary and oscillating tooth jaw plates confronting each other and converging with each other in a downward direction and dropping crushed glass and metal containers into the discharge chute. A glass discharging port in the bottom of the discharge chute directs glass particles directly into a collecting barrel. A gate is provided to alternately close the chute or to close the glass discharge port. The chute has a separating wheel at its bottom end to initially stop and then propel aluminum cans over the top of it. The wheel has magnetic belts to carry steel containers around with the wheel until they are stripped off and dropped into an appropriate barrel.

13 Claims, 6 Drawing Figures

3
10
45.2
26
25.1
26.1
27
26
27
25.1
23
13
25
13
24
29.1
29
28
25.2
28.1
29
13
12
12
13
37
36
45.1
38
42
43.1
43
44
45
3

CRUSHER AND SEPARATOR FOR CANS AND BOTTLES

This invention relates to a machine for crushing metal cans and glass bottles and for separating crushed glass from the cans and separating steel and aluminum cans from each other.

BACKGROUND OF THE INVENTION

There is a need for a simple efficient machine which will crush and separate empty cans and glass bottles. There have been various devices in the past to accomplish some crushing and some separating, but have not efficiently processed a wide variety of containers. In one machine of U.S. Pat. No. 3,687,062, a grid or screen allows pulverized glass to fall through for separating the glass from the cans. However usually, glass has paper adhered to it and as a result the glass with paper will not fall through this grid. A magnetic belt is used in this machine to obtain some separation of the steel cans from the aluminum cans.

Other magnetic devices such as rollers have been used in limited attempts to obtain separation of various types of ferrous and nonferrous metal cans.

SUMMARY OF THE INVENTION

An object of the invention is to provide a new and improved machine of simple and inexpensive construction in operation for crushing empty glass and metal containers and for separating the remaining material after crushing it.

Another object of the invention is to provide a novel machine which will crush either glass bottles or metal cans and will discharge the crushed aluminum, steel and glass into separate containers.

A further object of the invention is to provide an oscillating apparatus to progressively grip and pull a container into and through the apparatus as the container is being crushed.

A feature of the invention is the crushing apparatus through which an empty container moves; and a discharging mechanism including an inclined chute down which the crushed cans slide. The chute has a gate in its bottom wall for closing a port through which the crushed glass will fall when opened.

When the gate is closed, crushed cans will slide down the chute and bump into the periphery of a revolving separating wheel, and momentarily stop or hestitate. All cans will be lifted or deflected by the wheel off the chute to be discharged into collecting barrels or the like.

As crushed cans pass over the wheel, all the aluminum cans are propelled directly into one barrel, and the cans which have a steel end or a steel body, are magnetically adhered to the wheel as to turn with the wheel until a stationary deflector effectively knocks the steel can off the revolving wheel.

Accordingly, the invention provides the advantage of making a distinct and clear cut separation of the glass from both the all aluminum cans and the part or all steel cans.

Another feature of the invention is the container crushing apparatus which includes a stationary upright jaw plate and an inclined oscillating jaw plate in confronting relation to each other. Both plates have a rib-like teeth all across their faces to crush and pull the containers downwardly and between the coverging lower ends of plates.

The teeth are rib-like and have downwardly facing gripping surfaces adjacent the sharp-edged corners to alternately bite into and release the container during oscillation of the plate.

A principal advantage of this crushing apparatus is the uniform crushing of both glass and metal containers. The glass is crushed down to small particles; and the metal cans are mashed into flattened condition to occupy a minimum of space.

A further feature of the invention is the sensing of the containers being fed into the crusher as to start the motor and continue the operation for a period of time after the last container is fed into the machine. As bottles are fed into the machine, they are sensed and the gate at the bottom wall of the chute is moved to open the discharge port for crushed glass. After the last bottle is sensed, the gate will shortly return to its closed position.

DETAILED SPECIFICATIONS

Figure 1:
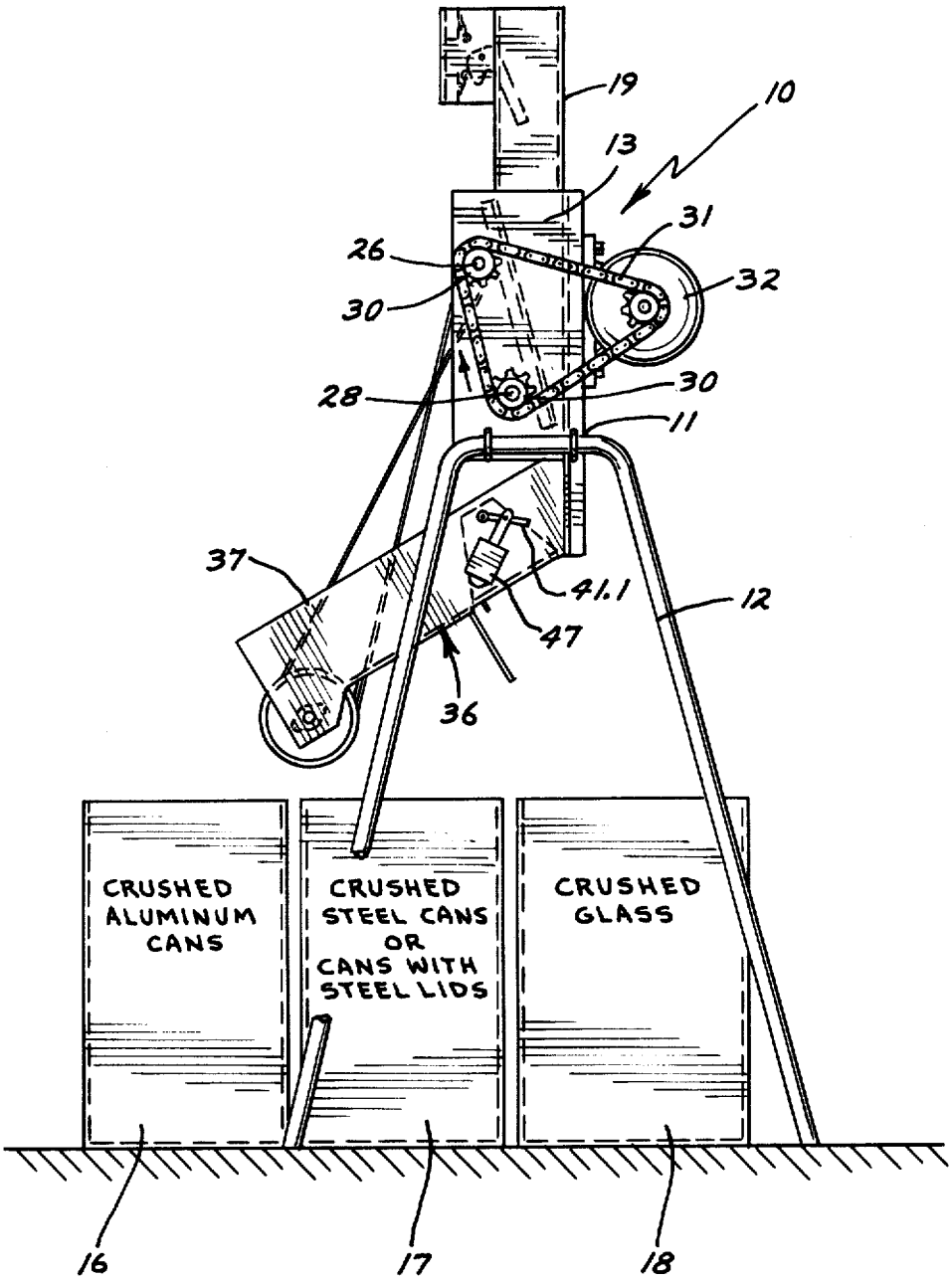
FIG. 1 is a side elevation view of the machine as a whole.

One form of the invention is shown in the drawings and is described herein. The can and bottle crushing and separating apparatus is indicated in general by numeral 10 and has a frame 11 including support legs 12 rigid side panels 13 affixed to the legs 12, and a rigid back panel 14. Between the side panels 13 there is a crushing chamber 15 with open top and bottom ends 15.1 and 15.2 respectively.

The legs 12 are sufficiently long so that scrap barrels 16, 17 and 18 may be located beneath the crushing and separating machine 10 so as to receive crushed containers of various materials. The scrap aluminum or crushed aluminum cans wil be received in the barrel 16; scrap containing a portion of steel or scrap entirely of steel wil be received in the barrel 17 and broken or crushed glass particles will be received in the barrel 18. A receiving duct 19 which is preferably square, but which could be cylindrical in shape is affixed at the top of the side plates 13 to deliver cans and bottles into the crusher. The cans which are usually crushed in this equipment are beer cans and pop cans. Many such cans are formed entirely of aluminum, but other of such cans are formed of steel. Some cans have aluminum bodies and steel lids and some cans have been known to have steel bodies and aluminum lids. In any event, such cans are fed into the machine by dropping them down the duct 19, and as cans drop through the duct 19, the feeler arm or sensing arm 20 is engaged by the dropping cans so as to operate a microswitch 21 to start the machine into operation. A second microswitch 22 is provided so that when a large glass bottle, such as a quart size whiskey bottle or wine bottle is received through the duct 19, the feeler arm 20 will be swung significantly over to the side and the second switch 22 will also be operated.

The crushing mechanism includes a pair of hardened steel jaw plates 23 and 24. Jaw plate 24 is stationary and is affixed as by screws to the stationary rigid back plate 14.

Figure 2:
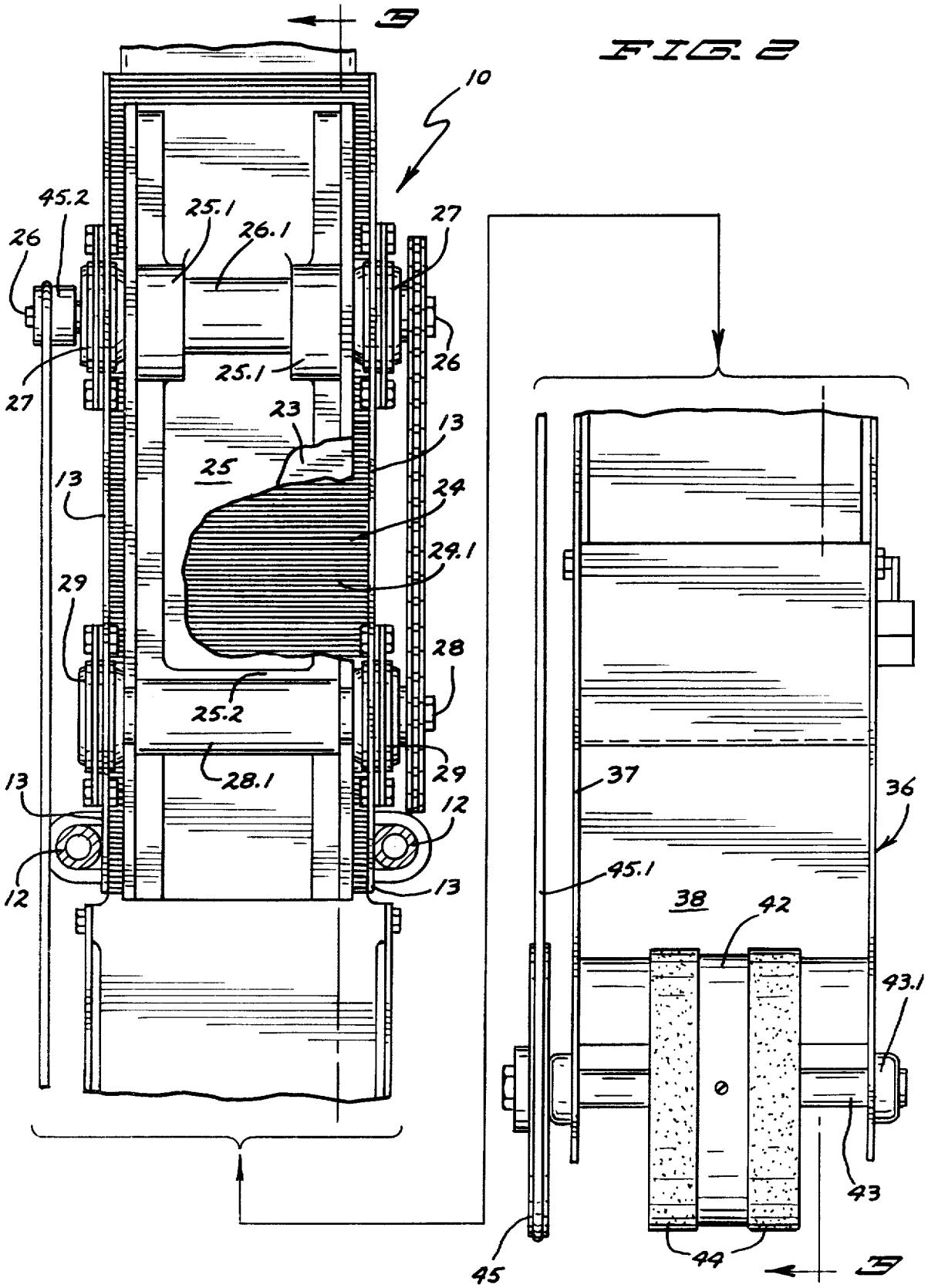
FIG. 2 is an enlarged elevation view shown in two segments.

The oscillating jaw plate 23 is affixed as by screws to a rigid mounting plate 25. It will be recognized that the stationary jaw plate 24 is disposed in substantially upright position and the oscillating jaw plate 23 is oriented in an inclined orientation, converging in a downward direction with the stationary jaw plate 24. The working faces of the stationary and oscillating jaw plates confront each other at opposite sides of the crushing chamber 15, and both of the plates 24 and 23 have a multiplicity of teeth 23.1 and 24.1 extending horizontally across and covering the full length of the working faces of the jaw plates from top to bottom. FIG. 2 illustrates that the rib-like teeth 24.1 on the stationary jaw plate 24 extends entirely across the plate from side to side; and the teeth 23.1 on the oscillating jaw plate similarly extend all across the entire width of the plate 23 to the extreme side edges thereof.

A drive shaft 26 which mounts and drives the upper portion of the mounting plate 25 and oscillating jaw plate 23 is jounaled in bearings 27 mounted on the side panels 13 of the machine. The shaft 26 has an enlarged cylindrical eccentric 26.1 extending through bearings 25.1 which are formed integrally of the mounting panel 25. It will be recognized that as the shaft 26 and eccentric 26.1 are revolved, the upper portion of the mounting plate and of the jaw plate 23 has a rotary oscillation, so as to move the upper portion of the jaw plate 23 both upwardly and downwardly and toward and away from the stationary jaw plate 24.

Another drive shaft 28 is journaled in bearings 29 affixed on the side panels 13 adjacent the lower portion of the mounting plate 25 and oscillating jaw plate 23. The shaft 28 has a cylindrical eccentric 28.1 which bears against the back surface of the mounting panel 25, at the pad 25.2. It will be recognized that as the shaft 28 and eccentric 28.1 are revolved, the eccentric produces oscillation of the lower portion of the oscillating jaw plate 23 toward and away from the stationary jaw plate 24, while accommodating the upper and downward movement produced in the rotary oscillation from eccentric 26.1.

The shafts 26 and 28 have sprockets 30 on their ends which are turned by a chain 31 driven from electric motor 32 which is mounted on the back panel 14.

Figure 4:
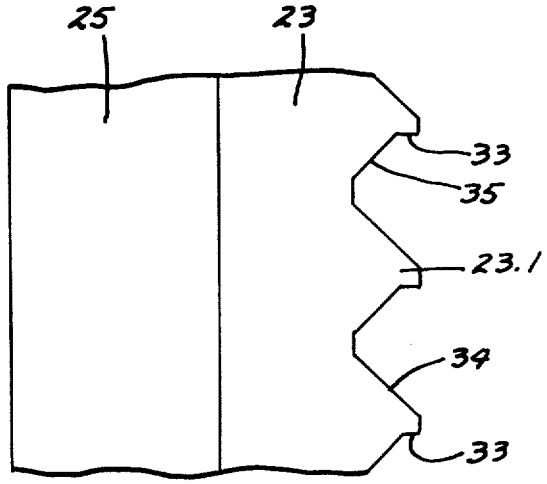
FIG. 4 is an enlarged detail section view illustrating the shape of the teeth on the face of the oscillating jaw plate.
Figure 5:
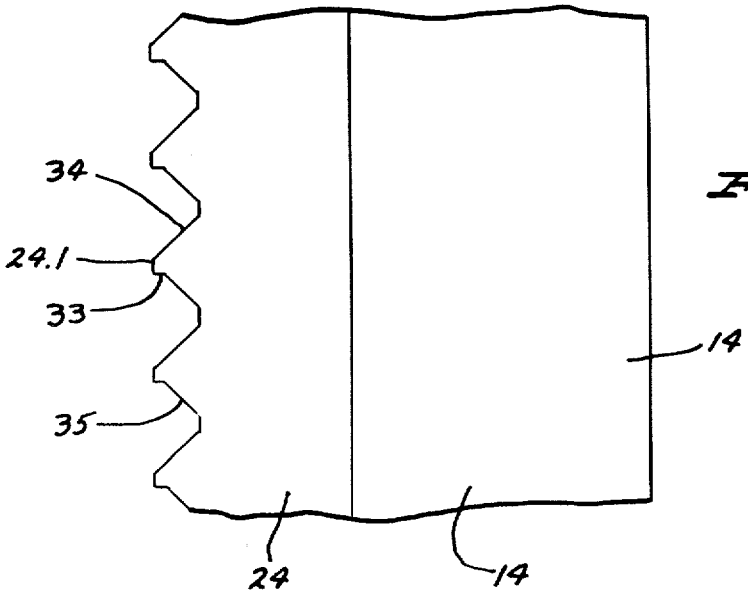
FIG. 5 is an enlarged detail section view illustrating the shape of the teeth on the face of the stationary jaw plate.

The typical shape of the teeth 23.1 and 24.1 on the jaw plates are illustrated in FIGS. 4 and 5. Although various shapes of teeth may be used, these shapes have been found to be quite successful. It is important that each of the teeth has a flat gripping or shoulder surface 33 facing downwardly adjacent the tip or ridge of the rib-like tooth. Each of the teeth also has a releasing surface 34 at an oblique inclined orientation extending upwardly from the tip or ridge of the tooth. Each of the teeth also has a second obliquely inclined releasing surface 35 extending upwardly toward the gripping surface 33. The teeth 24.1 on the stationary plate 24 are substantially similar in shape to the teeth on the oscillating plate 23, but the teeth 24.1 may be somewhat smaller and are spaced somewhat closer together.

A lower portion 14.1 of the stationary backing plate 14 extends significantly below the lower end of the crushing chamber 15, and a toothless lower portion 24.2 of the stationary jaw plate 24 also extends downwardly from the crushing chamber 15. A discharge chute indicated in general by numeral 36 extends at an inclined angle from the lower portion of the backing plate 14. The chute 36 has sidewalls 37 and a bottom wall 38. There is an opening or glass discharge port 38.1 through the bottom wall 38 adjacent the upper end of the chute and located directly beneath the lower end of the crushing chamber 15. A portion of the bottom wall 38 is bent downwardly to form a deflector or guide panel 39 so as to provide some direction to the glass particles which drop through the discharge port 38.1. A movable gate 40 normally closes the glass discharge port 38 as seen in full lines in FIG. 3, and the gate 40 lies substantially flush with the bottom wall 38 as to permit flattened cans C to freely slide down the chute after they drop from the lower end of the crushing chamber 15.

Figure 3:
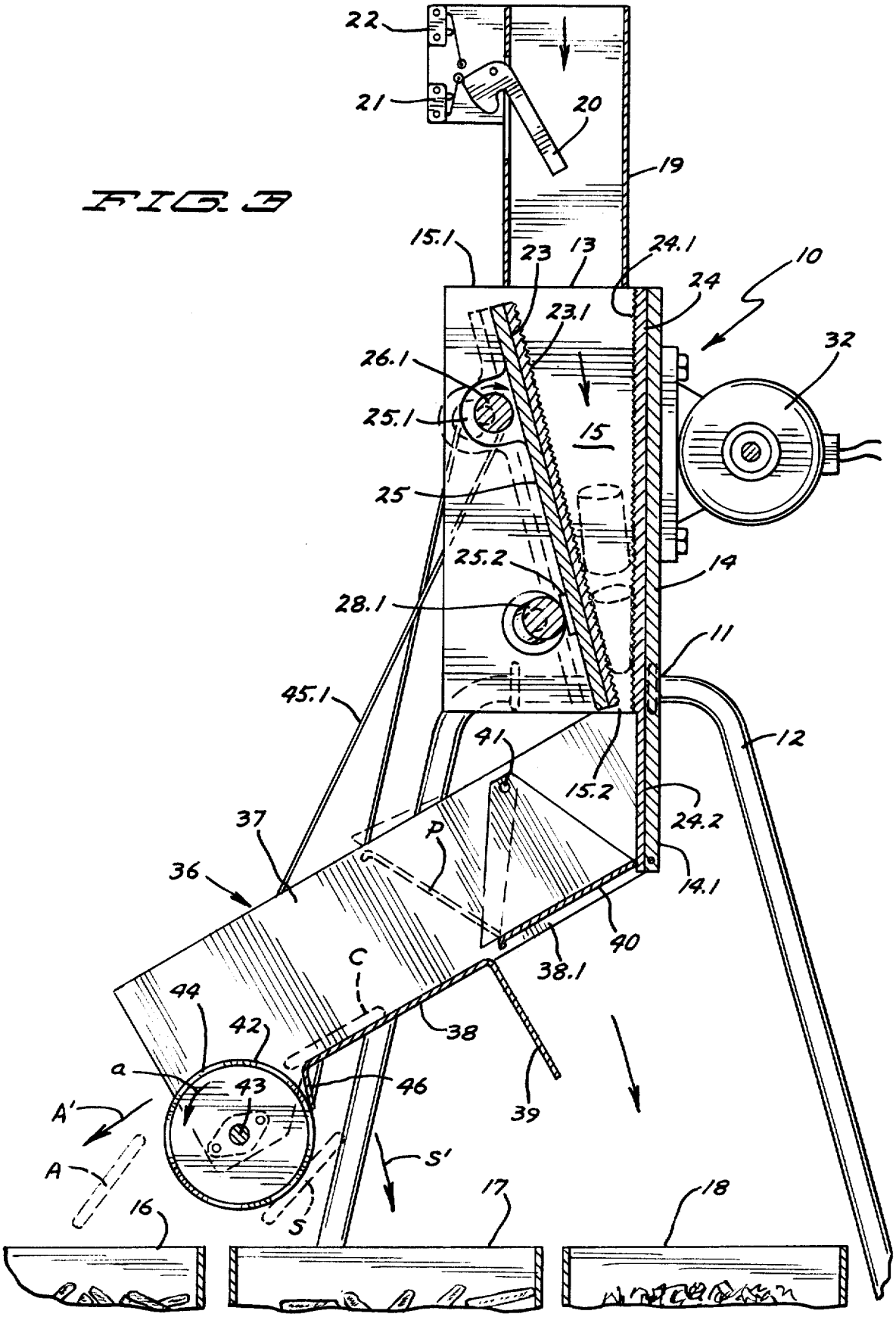
FIG. 3 is an enlarged detail section view taken approximately 3—3 in FIG. 2.

The gate 40 is swingably mounted on a control rod 41 which extends through the opposite upright sides 37 of the chute. Accordingly, the gate 40 may be swung out of the full line position as seen in FIG. 3 and to the dotted line position P as to open the glass discharging port 38.1 and as to obstruct the lower portion of chute 36 to prevent any of the crushed glass particles from moving down the chute and requiring all of the glass particles to fall or drop through the port 38.1 and into the barrel 18.

A separating wheel or drum 42 is mounted on a shaft 43 which revolves on a axis extending transversely of the chute and transversely therebelow. The separating wheel or drum 42 has a pair of magnetic belts 44 extending around the periphery thereof. The magnetic belts 44 may be formed of any of a number of materials, one of which is known by its trade mark Plastiform manufactured and sold by 3-M Company of St. Paul, Minn.

The shaft 43 of the separating wheel 42 is mounted in bearings 43.1 on the sidewall 37 of the chute and is driven by pulley 45 and belt 45.1 driven from a pulley 45.2 on the shaft 26. It will be recognized in FIG. 3 that the belt 45.1 is crossed in order to obtain the correct rotation of the separating wheel in the direction of Arrow a.

A deflector panel 46 is formed integrally of the bottom wall 38 of the chute and is located immediately adjacent the magnetic belt 44 on the periphery of the separating wheel 42. The deflector 46 effectively skims over the surface of the magnetic belts 44 in order to knock off the steel cans which adhere to the magnetic belt, and cause the steel cans to drop into the barrel 17. Containers C which do not have any steel in them, are simply propelled by the separating wheel 42 as indicated by the flattened aluminum container A which are generally thrust in the direction indicated by Arrow a A' in FIG. 3.

It is especially important to note that as the containers C are discharged from the lower end 15.2 of the crushing chamber, they will drop into the chute 36 and slide down the bottom wall until the container bumps into the periphery of the revolving wheel 42. The crushed container or piece of scrap C will hesitate as it first engages the periphery of the wheel and the sliding container loses some of its sliding energy so that the container C may be immediately controlled by the revolving wheel 42.

The periphery of the wheel will cause the leading edge of the container C to be lifted and the container will be carried over the wheel because of the rotation of the wheel. Aluminum cans A will be simply propelled into the barrel 16. Steel containers S adhere to the magnetic belts 44 and are carried around on the peripheral surface of the wheel until they are knocked off by the deflector 46 whereupon the steel crushed container S will drop into the barrel 17 substantially as indicated in the manner indicated the the Arrow S'.

A lever 41.1 seen in FIG. 1 is provided on the end of shaft 41 at the outside of the sidewall 37 of the chute 36. The lever 41.1 may be utilized for the purpose of swinging gate 40 to its alternate positions. This gate may be manually swung, but in the form of the invention illustrated in the drawings, electric solenoid 47 is mounted on the sidewall 37 of the chute and has its armature connected with the lever 41.1 for producing swinging of the lever and of the gate 40 when the armature of the solenoid is retracted.

Figure 6:
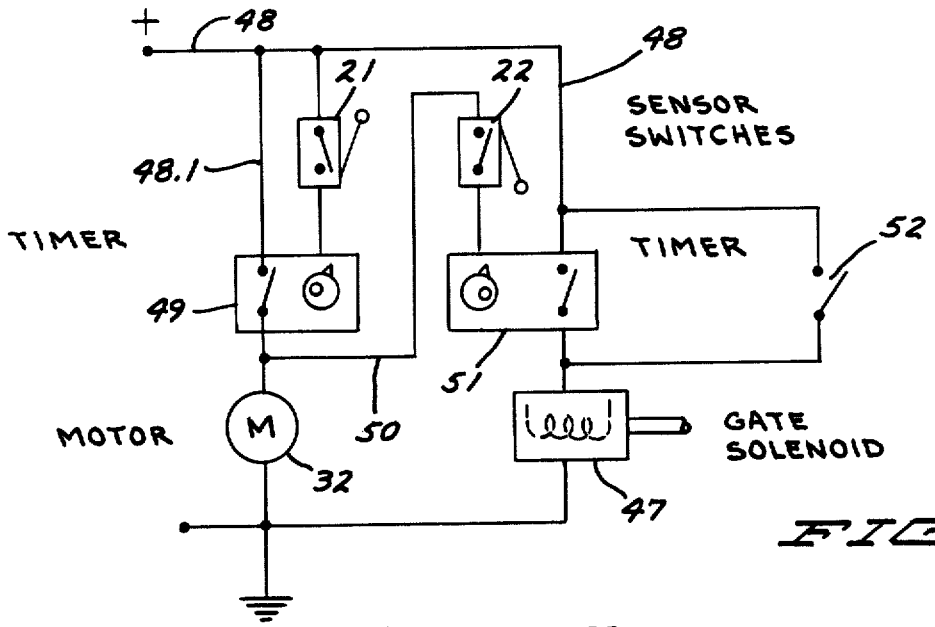
FIG. 6 is a schematic drawing of the electrical circuit typically used with the present invention.

The circuit shown in FIG. 6 provides for power to be connected to the lead 48 which supplies the power to the microswitch 21. A timer switch 49 will cause motor 32 to start as soon as the switch 21 is closed. The timer switch 49 will cause the power to be supplied to the motor 32 for a preselected length of time to which the timer is adjusted. The timer 49 will supply motor 32 with power from lead 48.1 after the timer is initially set into operation by closing microswitch 21. When the motor has been energized, the conductor 50 will supply power to the microswitch 22 in order to prepare the microswitch to be rendered effective when a large bottle is sensed and the feeler operates the microswitch 22. When this occurs, timer 51 is operated causing the switch therein to close and supply power to the solenoid 47 directly from lead 48. The solenoid 47 will remain closed for a predetermined length of time, selected at the timer 51 so that the bottle may be entirely crushed before the solenoid is allowed to return to its original state and return the gate 40 to its closed position. In this circuit arrangement, an extra switch 52 may be provided for manually operating the solenoid to swing the gate 40 to its shifted position.

In operation, as beer cans are dropped into the duct 19, the feeder will sense them and start the motor 32. Oftentimes the crushing chamber 15 will be essentially filled with beer cans, as will the duct 19. The motor 32 will continue to oscillate the oscillating jaw plate 23 until all of the beer cans have cleared the duct 19 and for a reasonable length of time thereafter to allow all of the beer cans to be crushed in the chamber 15. As the beer cans are crushed and a series of flattened containers C are dropped from the lower end 15.2 of the crushing chamber, these crushed containers C will slide down the chute, bump into the periphery of the wheel 42 which is revolving, and the crushed containers will hesitate slightly and then be picked up on the periphery of the wheel 42. Aluminum containers A will be simply propelled into the barrel 16 and steel containers S will be adhered to the magnetic belts 44 and carried around the wheel until they encounter the deflector 46, whereupon the steel or part steel containers will be dropped into the barrel 17.

After all of the beer cans and pop cans have been crushed, then a series of bottles such as wine bottles or quart sized whiskey bottles will be dropped into the duct 19. When these bottles are engaged by the feeler arm 20, the microswitch 22 is operated as to operate the timer to actuate the solenoid 47, whereupon the gate 40 swings to the dotted line position P illustrated in FIG. 3. The crushed glass particles will drop directly from the lower end of the crushing chamber 15 through the opening 38.1 and be deflected by the panel 39 into the barrel 18. Glass particles will be prevented from moving down the chute by the gate 40 which is swung to obstruct the chute.

The size of the sprockets on motor 32 and at the shafts 26 and 28 are selected as to cause the shafts 26 and 28 revolve at a speed of approximately 70 cycles per minute as to cause the oscillating jaw plate 23 to oscillate at approximately 70 cycles per minute. The speed of the oscillating jaw plate 23 may be increased to 120 cycles per minute, or may be lowered to 50 cycles per minute, but it has been found that an approximate speed of 70 cycles is preferable. Other speeds outside of these ranges may be utilized as well.

The oscillating jaw plate 23 will preferably have an acute angle with respect to the stationary jaw plate of approximately 15 degrees. When this angle is substantially increased or substantially decreased, the teeth on the faces of the plate grip the cans and bottles with considerably less efficiency. Although angles of 12 degress to 25 degrees have proven to allow the machine to operate, an angle approximately 15 degrees between the movable and stationary jaw plate is found to be preferable. For certain types of cans and bottles and other materials, it may be possible to vary considerably from the specified range of angles, but for ordinary beer cans, pop cans and whiskey bottles, these range of angles between the stationary and oscillating jaw plates have been found to be preferable.

As a bottle is fed into the crushing chamber 15, the oscillating jaw plate 23 will bear firmly against the bottle and will cause the bottle to be crushed and broken and then the major portions of the broken bottle will be drawn downwardly through the crushing chamber to be broken down into small particles to be dropped into barrel 18.

Steel and aluminum cans are gripped and moved downwardly between the jaws during each cycle of operation. The depending flat gripping faces 33 of the teeth on the oscillating jaw will engage and grip the metal of the can and cause crushing and downward movement of the cans during each cycle. As the jaw plate oscillates out and up again, the teeth of the stationary jaw plate 24 will trip the can and prevent the can from moving upwardly again. As this repeatedly occurs, the can is progressively drawn down through the crushing chamber and flattened into a simple piece of scrap.

It will be seen that the present machine crushes and separates both glass and various types of metal containers and drops the scrap into selected barrels so that the scrap may be disposed of or recycled. Glass containers are crushed into small particles and dropped into a separate barrel and the metal cans are crushed and then as they encounter the separating wheel 42, the aluminum and steel containers are separated and dropped into their separate barrels 16 and 17.

What is claimed is:

1. A crusher and separator for metal and glass containers, comprising a crushing means for mashing such containers into scrap by reducing metal cans into flattened condition and glass bottles into small particles, an inclined discharge chute below the crushing means receiving the scrap from the crushing means and having a bottom wall with a lower end and a revolving separating wheel at the lower end of the bottom wall, the wheel revolving on a horizontal axis below the bottom wall and transverse to the chute and the wheel having a portion of its periphery protruding upwardly of the lower end of the bottom wall to obstruct smooth sliding of the flattened cans down and off the chute and causing the flattened cans to hesitate, the wheel having a magnet on its periphery to adhere flattened steel cans thereto, the wheel propelling flattened aluminum cans from the chute, the bottom wall of the inclined chute having a glass discharging port therein directly below the crushing means and spaced along the chute above the lower end thereof, the wheel having upper and lower portions of its periphery, the chute being adjacent the upper portion of the periphery for delivering flattened cans thereto, there being open and unobstructed space adjacent the lower portion of the periphery of the wheel to permit all flattened cans to move downward adjacent the lower portion of the periphery of the wheel, a deflector beneath the lower end of the bottom wall and adjacent the periphery of the separating wheel to knock the steel cans off the revolving wheel and magnet, the steel cans dropping at a location spaced from the discharging of the aluminum cans, and a movable gate traversing the glass discharging port and allowing crushed cans to slide thereover to the separating wheel, the gate being movable to open the port and permit glass particles to fall through at a location spaced from the dropping of the steel cans.

2. The invention according to claim 1 and means swingably mounting the gate to permit the gate to swing between normal position traversing the glass discharging port and lying substantially flush with the bottom wall of the chute, and shifted and substantially upright position transverse to the bottom wall and downward along the chute from the port to allow and guide glass particles to drop through the port while preventing travel of the particles down the chute toward the separating wheel.

3. The invention according to claim 1 and means moving the gate between open and closed condition relative to the port, and means sensing a glass bottle supplied into the crushing means and operating the moving means to open the port in response to presence of a sensed bottle.

4. The invention according to claim 1 and the separating wheel being shaped as a drum and traversing the width of the discharge chute.

5. A crusher and separator for cans variously made of aluminum and at least part steel, comprising crushing means for mashing such containers into scrap by reducing the metal cans into flattened condition, an inclined discharge chute receiving scrap from the crushing means and having a bottom wall with a lower end and a revolving separating wheel at the lower end of the bottom wall, the wheel revolving on a horizontal axis below the bottom wall and transverse to the chute and the wheel having a portion of its periphery protruding upwardly of the lower end to obstruct smooth sliding of the flattened cans down the chute and causing the flattened cans to hesitate, the wheel having a magnet on its periphery to adhere flattened steel cans thereto, the wheel propelling the flattened aluminum cans directly from the chute, the wheel having upper and lower portions of its periphery, the chute being adjacent the upper portion of the periphery of the wheel for delivering flattened cans thereto, there being open and unobstructed space adjacent the lower portion of the periphery of the wheel to permit all flattened cans to move downward adjacent the second side of the wheel, and a deflector beneath the lower end of the bottom wall and adjacent the periphery of the separating wheel to knock the flattened cans off the revolving wheel and magnet, the flattened steel cans dropping at a location spaced from the discharging of the flattened aluminum cans.

6. The invention according to claim 5 and the magnet being arranged in a peripheral belt all around the wheel.

7. A crusher for metal and glass containers, comprising frame means including a pair of upright rigid side panels confronting each other in spaced relation and defining a crushing chamber therebetween, the crushing chamber having open top and bottom ends, a stationary jaw plate and oscillating jaw plate both being upright and extending between the side panels and having working faces in confronting relation to each other to enclose the crushing chamber, the stationary jaw plate being affixed to the side panels and the oscillating jaw plate being movable between the side panels and being inclined in downwardly converging relation to the stationary jaw plate, each of the jaw plates having a back side opposite the working face and having a multiplicity of unbroken rib-like teeth extending horizontally and continuously across the working face thereof, a first driven rotary eccentric extending horizontally across and suspending the upper portion of the upright oscillating jaw plate for rotatably oscillating the upper portion of the jaw plate upwardly and downwardly and toward and away from the stationary jaw plate, a second driven rotary eccentric slidably bearing against the lower portion of the oscillating jaw plate at the back side thereof and to produce oscillation of the lower portion of the plate toward and away from the stationary jaw plate while also accommodating the upward and downward oscillation produced by the first eccentric, whereby to reduce containers to scrap as they are fed into the top of the crushing chamber by mashing metal cans into flattened condition as the cans are progressively pulled downwardly and breaking the glass into small particles, and means beneath the crushing chamber to collect and sort the scrap by the nature of the material in the scrap.

8. The invention according to claim 7 and the teeth on the working faces of both the oscillating and stationary jaw plates having downwardly facing gripping surfaces to engage and cooperate with each other in pulling the containers downwardly as the containers are mashed between the plates.

9. The invention according to claim 8 and the teeth on the working face of the oscillating jaw plate also having tip portions and having releasing surfaces inclined downwardly toward such tip portions.

10. The invention according to claim 9 and the teeth also having releasing surfaces inclined upwardly toward the gripping surfaces.

11. The invention according to claim 7 and means controlling starting and stopping of the eccentrics, and means sensing dropping of a container into the crushing chamber and operating the control means to start and continue operation of the eccentric for a time to allow completion of the crushing of the container.

12. The crusher according to claim 7 and inclined discharge chute beneath the lower end of the crushing chamber and receiving the scrap therefrom, the inclined chute having a bottom wall with a glass discharging port therein located substantially beneath the lower end of the crushing chamber to permit glass particles to fall directly through the port to be collected, the bottom wall having a lower end, and a separating wheel revolving on a horizontal axis below the bottom wall and transverse to the chute, and the wheel having upper portions of its periphery protruding upwardly of the lower end of the chute and significantly above the lower wall to obstruct smooth sliding of flattened cans down the chute and to cause all flattened cans to hesitate at the wheel, the wheel having a belt magnet on its periphery to adhere flattened steel cans thereto, the wheel first engaging flattened cans at the upper portions of its periphery and on the chute, and the wheel lifting and propelling flattened aluminum cans thereover and away from lower portions of the periphery of the wheel and without significantly changing direction of the flattened cans, the magnetic belt adhering to the flattened steel cans as they hesitate and are lifted and the wheel changing direction thereof as they travel around the revolving wheel, there being completely open an unobstructed space adjacent the lower portions of the periphery of the wheel, a deflector beneath the lower end of the bottom wall and adjacent the periphery of the separating wheel to knock the flattened steel cans off the revolving wheel and magnet causing the flattened steel cans to drop at a location spaced from the discharging of the flattened aluminum cans, and a movable gate traversing the glass discharging port and allowing crushed cans to slide thereover, the gate being movable to alternately open the port and cause closing of the chute to permit glass particles to fall through the port at a location spaced from the dropping of the flattened steel cans.

13. A crusher for metal and glass containers, comprising a stationary jaw plate and an oscillating jaw plate both being substantially upright and having working faces in confronting relation to each other to define a crushing chamber therebetween, the working faces being continuous and unbroken betwen the sides thereof, the oscillating jaw plate being inclined in downwardly converging relation to the upright stationary jaw plate, each of the jaw plates having a multiplicity of rib-like teeth extending horizontally and continuously across the working face thereof, means cooperating with said jaw plates enclosing the sides of the crushing chamber between the plates, a first cam operated driving means engaging and suspending the upper portion of the upright oscillating jaw plate and rotatably oscillating the upper portion of the plate upwardly and downwardly and toward and away from the stationary jaw plate, and a second drive means slidably bearing against the lower portion of the oscillating jaw plate at the back side thereof and opposite the working face and producing oscillation of the lower portion of the plate toward and away from the stationary jaw plate while also accommodating the upward and downward oscillation produced by said first cam operated driving means, whereby to reduce containers to scrap as they are fed into the top of the crushing chamber by mashing metal cans into flattened condition as the cans are progressively pulled downwardly and breaking glass bottles into small particles, and means beneath the crushing chamber to collect and sort the scrap.

* * * * *